United States Patent [19]

Graninger

[11] 4,256,021

[45] Mar. 17, 1981

[54] PNEUMATIC TIMER WITH ECCENTRICALLY DISPOSED VALVE NEEDLE

[75] Inventor: Frank J. Graninger, Milwaukee, Wis.

[73] Assignee: Allen-Bradley Company, Milwaukee, Wis.

[21] Appl. No.: 50,752

[22] Filed: Jun. 21, 1979

[51] Int. Cl.[3] ..... F01B 29/08

[52] U.S. Cl. ..... 92/143; 138/45; 251/122; 335/61

[58] Field of Search ..... 251/122; 138/45, 46; 91/418; 92/143, 34

[56] References Cited

U.S. PATENT DOCUMENTS

| | | | |
|---|---|---|---|
| 1,326,998 | 1/1920 | Wallace | 251/122 |
| 1,988,819 | 1/1935 | Stuart | 251/122 |
| 3,084,865 | 4/1963 | Fleer et al. | 251/122 X |
| 3,249,716 | 5/1966 | Haydu et al. . | |
| 3,957,930 | 5/1976 | Birmingham | 251/122 X |

FOREIGN PATENT DOCUMENTS 2323206 11/1973 Fed. Rep. of Germany ..... 251/122

*Primary Examiner*—Irwin C. Cohen
*Attorney, Agent, or Firm*—Quarles & Brady

[57] ABSTRACT

A pneumatic timer for a timing relay is regulated by the axial movement of a valve needle through a chamber formed in the body of the timer. The valve needle forms a tapered valve stem along its longitudinal axis and the valve stem is eccentrically disposed in a passageway leading from the valve chamber to provide a crescent-shaped bleed area between the valve chamber and the interior of an expandable bellows. Springs are disposed in the valve chamber to bias the needle to its eccentric position, where the valve stem contacts a portion of a valve seat formed around the passageway. The size of the bleed area between the valve stem and the noncontacting portion of the valve seat changes as the valve needle is moved along its axis, but the shape of the bleed area remains substantially the same, so that the valve can more easily be set to provide the desired time delay.

3 Claims, 13 Drawing Figures

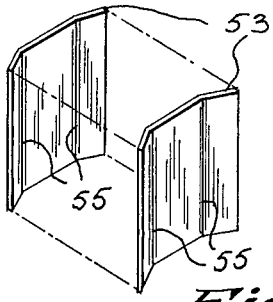
Fig. 5
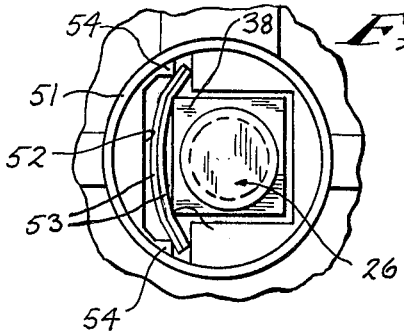
Fig. 6
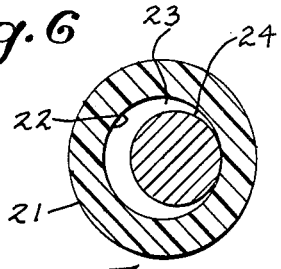
Fig. 7
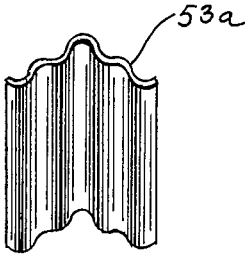
Fig. 8
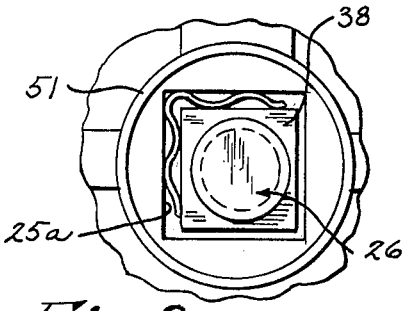
Fig. 9
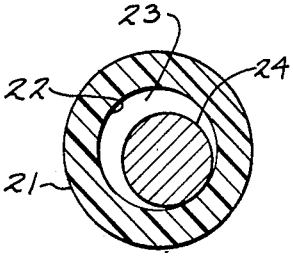
Fig. 10
Fig. 12
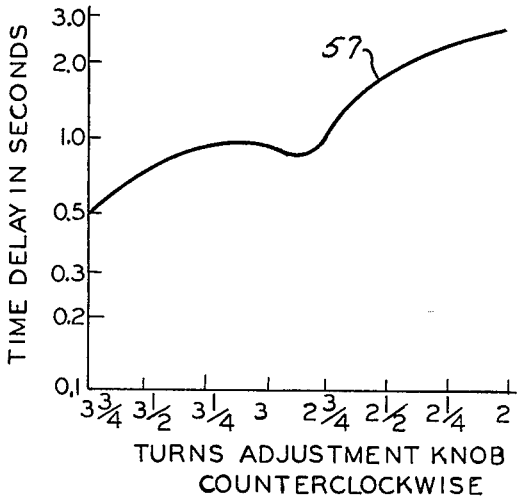
Fig. 11
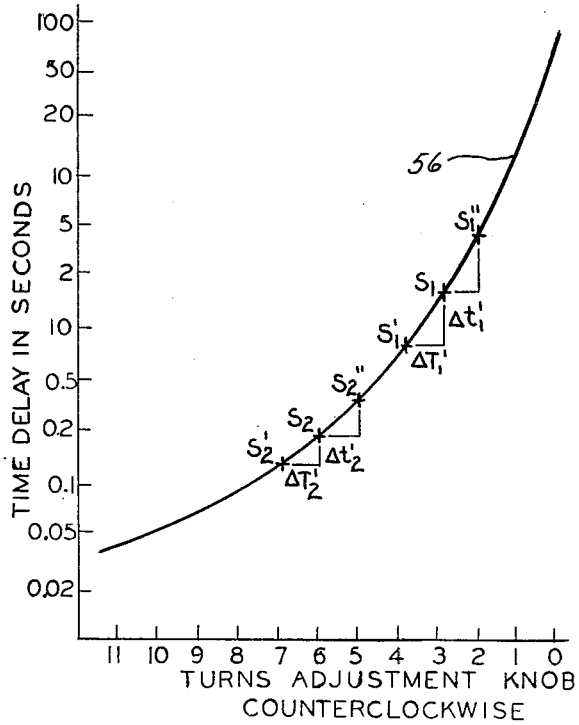
Fig. 13
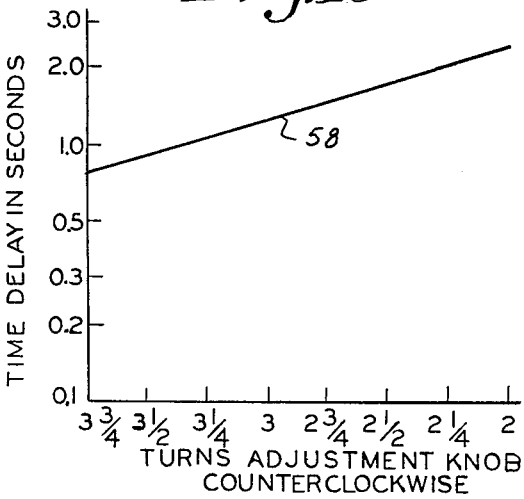

PNEUMATIC TIMER WITH ECCENTRICALLY DISPOSED VALVE NEEDLE

BACKGROUND OF THE INVENTION

1. Field of the Invention

The field of the invention is pneumatic timing devices, and more particularly, those devices used in timing relays to provide a time delay between the operation of a relay electromagnet and the actuation of some relay switch contacts. Timing relays are used in circuits for controlling industrial machines and processes of many kinds, particularly those machines and processes that are driven by one or more electrical motors.

2. Description of the Prior Art

Pneumatic timers with needle-type valves are disclosed in Haydu et al, U.S. Pat. No. 3,249,716, issued Dec. 26, 1963, and in a copending application, Ser. No. 895,728, filed Apr. 12, 1978, and assigned to the assignee of the present invention. This copending application is directed to an adjustment mechanism for controlling the axial position of a valve needle. The needle extends from a valve chamber into a passageway that opens into the interior of a bellows. The valve needle controls the rate of air flow into the bellows, thereby controlling its expansion.

Besides having a mechanical adjustment that is easily and conveniently operated, a pneumatic timer should permit an operator to easily locate a particular time setting. The scale on the typical timer provides only an approximate setting. The scale is used to make a first, coarse setting of the timer, at which the actual time delay period is observed. Additional, finer settings can then be made until the actual time delay period is exactly, or within a tolerable amount of, the desired time delay period. The fewer settings that are needed, the better is the measure of adjustability of the timer.

Adjustability can be adversely affected in the manner of backlash or hysteresis, so that a timer provides inconsistent time delays from one setting to the next. This is observed when a timing reference mark is moved away from a scale mark, and is then moved back again to that mark, and where the resulting time delay is different for the second setting than for the first. Generally speaking, this is caused by a change in the shape of the valve opening and the rate of air flow therethrough. More specifically, this can be caused by the rotation of a valve needle that is not concentrically formed around its longitudinal axis, though still within manufacturing tolerances. The shape of the valve opening can also be changed when the valve needle is shifted laterally, or tilted to a position non-parallel to the longitudinal axis of its surrounding chamber.

In a prior construction, a rectangular flange formed on a valve needle to limit rotation is separated by a narrow gap from the interior walls of the valve chamber. This allows the needle to rotate, shift or tilt, or possibly move in all of these ways, with an adverse effect on the adjustability of the device.

SUMMARY OF THE INVENTION

The invention is incorporated in a pneumatic timer of the type having a needle valve, wherein the needle is eccentrically disposed in a passageway leading into the interior of a bellows. The valve needle has a stem that contacts a portion of a valve seat formed around the passageway, and the stem is laterally spaced from another portion of the valve seat to form an opening called a "bleed area." Adjustment means are provided to move the valve needle and its stem longitudinally to control the size of the bleed area.

The eccentric disposition of the valve needle in contact with a portion of the valve seat provides a bleed area of substantially constant shape, even though the size of the bleed area and the volume of the open portion of the passageway are changing. The contact with the seat contributes to the frictional forces that prevent the needle from rotating.

The valve stem and the air passageway can only be made circular in cross section to a specified tolerance. Where a valve stem is disposed approximately concentric with a peripheral valve seat, rotation of the valve needle can cause a slight change in the shape of the bleed area. This can further cause a different rate of flow and a different time delay operation for two apparently identical settings. The timer of the present invention overcomes this problem.

The prior art provided only a rectangular flange on the needle to counteract rotation. Besides disposing the needle eccentrically in the passageway, the present invention further provides biasing means disposed in the valve chamber for laterally urging and holding the valve needle in its eccentric position. This counteracts the effects of any gap between the rectangular needle flange and the walls of the valve chamber. It also minimizes any tilting of valve needle that results from tolerance variations in the gear mechanism supporting its upper end.

One object of the invention is to provide a pneumatic timer that can be easily and accurately set to provide a desired time delay.

Another object of the invention is to counteract the effects of looseness, play and tolerance variations in the mechanical parts of a pneumatic timer.

Another object of the invention is to retain the ability to easily operate the mechanical adjustment knob.

Another object of the invention is to minimize the effects of shock and vibration upon a relay timing device used in an industrial environment.

The foregoing and other objects and advantages of the invention will appear from the following description. In the description reference is made to the accompanying drawings which form a part hereof, and in which there is shown by way of illustration two embodiments of the invention. Such embodiments do not necessarily represent the full scope of the invention, however, and reference is made to the claims for determining the scope of the invention.

BRIEF DESCRIPTION OF THE DRAWINGS

FIG. 5 is a perspective view of two springs seated in the valve chamber in FIG. 3;

FIG. 6 is a top detail view of the valve chamber seen in FIG. 3;

FIG. 7 is a view in cross section taken in the plane indicated by line 7—7 in FIG. 4;

FIG. 8 is a perspective view of a spring included in a second embodiment of the invention;

FIG. 9 is a top detail view of the same area as FIG. 6 for a second embodiment of the invention;

FIG. 10 is a view in cross section in the same plane as FIG. 7 for a second embodiment of the invention;

FIG. 11 is a graph on a semilog scale of a timing function curve for a typical pneumatic timer;

FIG. 12 is a graph on a semilog scale of a portion of a timing function curve for a pneumatic timer of the prior art; and FIG. 13 is a graph on a semilog scale of a portion of a timing function curve for a pneumatic timer of the present invention.

DETAILED DESCRIPTION

Figure 1:
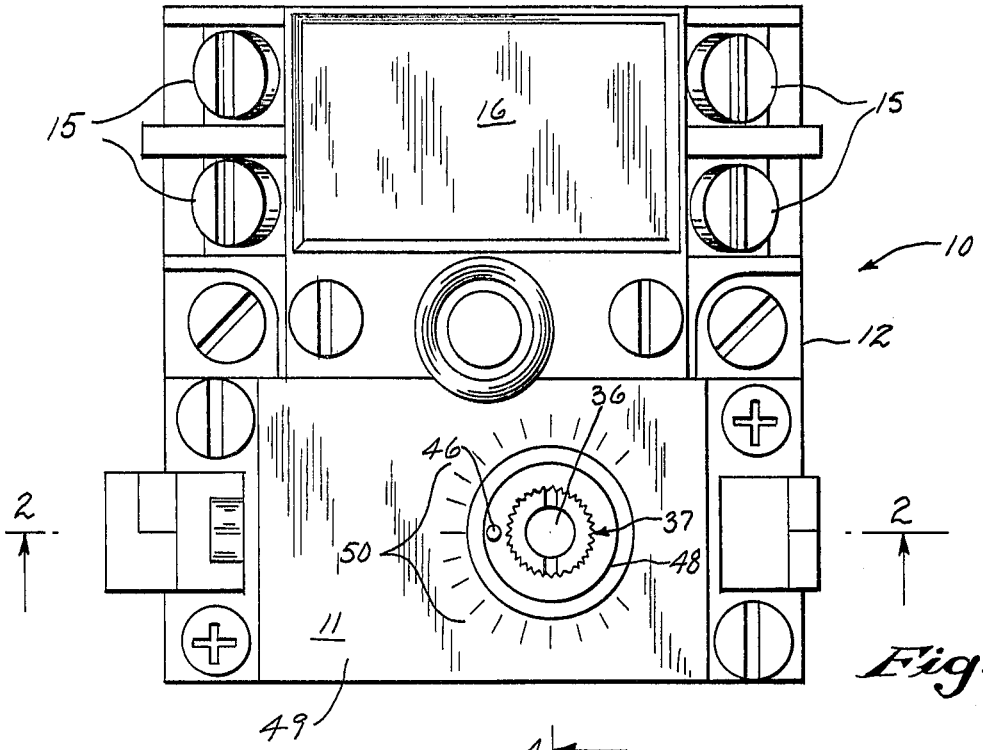
FIG. 1 is a top view of a time delay relay that includes a pneumatic timer of the present invention.
Figure 2:
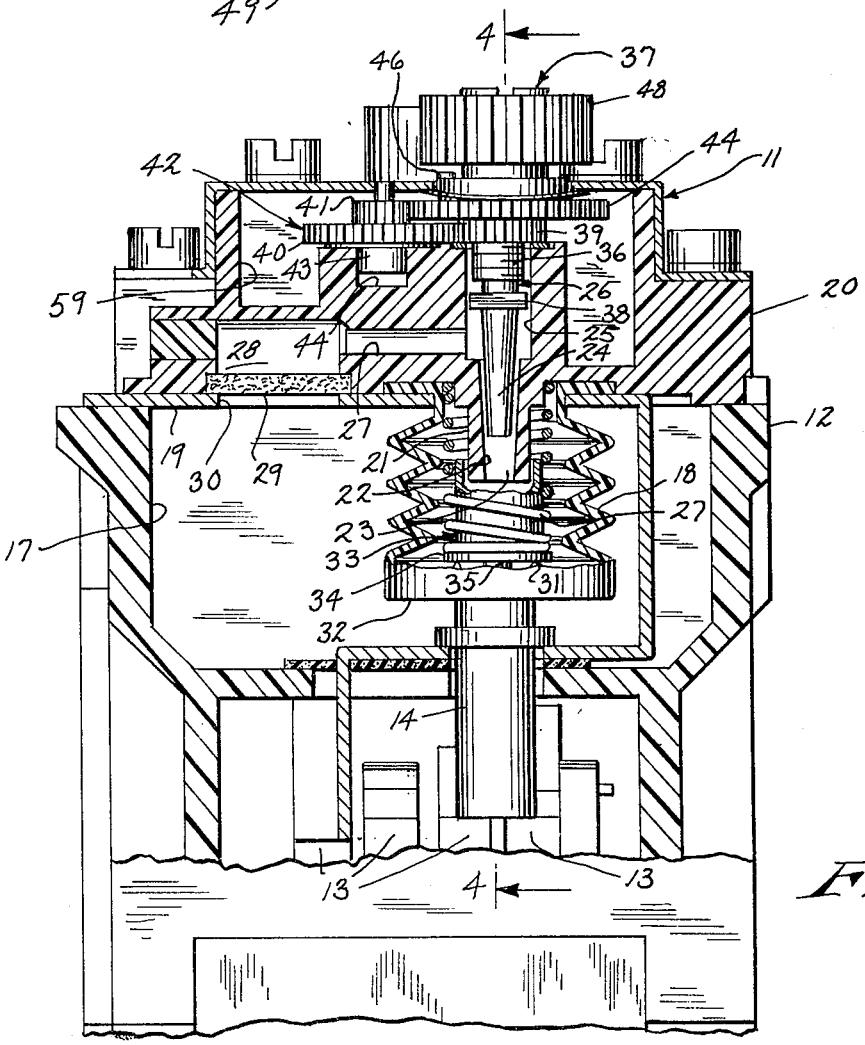
FIG. 2 is a vertical view in cross section of the time delay relay, and the pneumatic timer included therein, taken in the plane indicated by line 2—2 in FIG. 1.

A preferred embodiment of the invention is incorporated in a time delay relay 10 seen in FIGS. 1 and 2, and more particularly, in a pneumatic timer 11 that is mounted on an upper housing 12 of the relay 10. A set of four levers 13, disposed within the upper housing 12 in FIG. 2 are coupled to a movable armature of a relay electromagnet (not shown), to reset an actuator button 14 on the pneumatic timer 11 upon either the energizing or deenergizing of the relay electromagnet. The actuator button 14 is also coupled through two of the levers 13 to a contact actuator (not shown) in the relay 10 to operate a set of contacts (not shown). The contacts are housed within cartridges having terminals 15 that extend out from beneath a cover 16 above the contact cartridges as seen in FIG. 1.

The actuator button 14 moves downward over different time periods, according to the setting of the timer 11, to actuate the contacts after a delay from the energizing or deenergizing of the relay electromagnet. The details of this contact actuation are set forth in an allowed patent application, Ser. No. 895,547, filed Apr. 12, 1978, and assigned to the assignee of the present invention. The operation and the internal construction of the pneumatic timer 11, without the improvement of the present invention, is described in a copending application, Ser. No. 895,728, filed Apr. 12, 1978, and assigned to the assignee of the present invention.

As seen in FIG. 2, the pneumatic timer 11 sits upon the upper housing 12 and closes a cavity 17 formed therein. A collapsible bellows 18 depends from a thin, metal, horizontal mounting plate 19 attached to the bottom of a timer body 20. The body 20 is molded from a thermoplastic resinous material into a complex configuration with a number of cavities to be described.

The body 20 has a hollow barrel 21 extending downward through an opening in the mounting plate 19 into the interior of the bellows 18. An interior surface within the barrel 21 forms valve seat 22 around a vertical air passageway 23. The flow of air through this passageway 23 is controlled according to the position of a tapered valve stem 24 control the rate at which the bellows 18 and the actuator button 14 advance during a timing operation.

The air passageway 23 opens at its upper end into a primary valve chamber 25, and a valve needle 26 extends through the valve chamber 25 and forms the valve stem 24 that extends into the air passageway 23. A horizontal air inlet duct 27 opens at one end into the valve chamber 25 and opens at its other end into one side of a rectangular filter chamber 28. An air filter 29 is disposed over the mouth of the air filter chamber 28 to filter air that is drawn from the relay housing cavity 17, through an opening 30 in the mounting plate 19. Air is drawn from the large cavity 17 in the upper housing 12 to the interior of the bellows 18, to allow it to expand. Air is exhausted from the interior of the bellows 18 back into the housing cavity 17 as the bellows is compressed by the upward reset stroke of one of the levers 13 against the actuator button 14.

Figure 4:
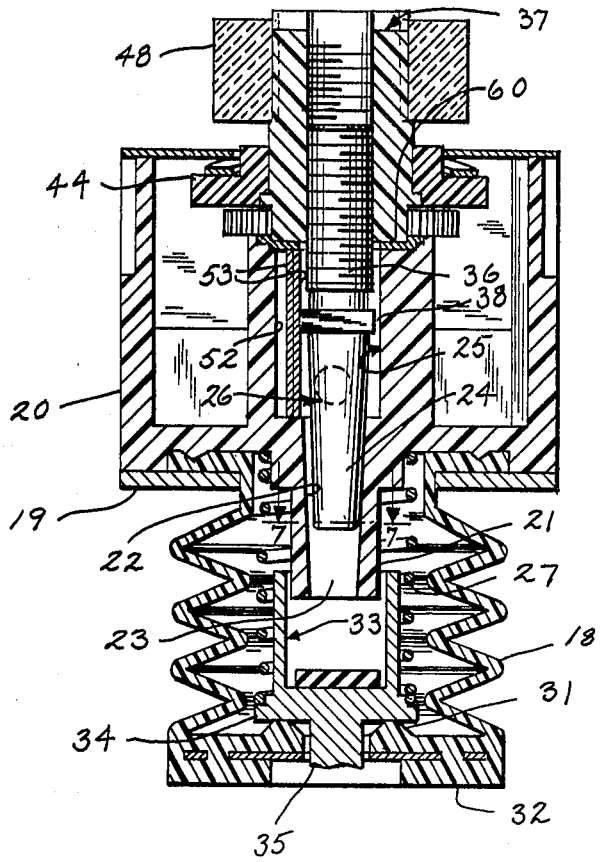
FIG. 4 is a vertical view in cross section of the pneumatic timer taken through the plane indicated by line 4—4 in FIG. 2.

If the upward movement of the actuator button 14 is too rapid, the bellows will not collapse quickly enough unless some other escape is provided for the air within. Therefore, as seen in FIGS. 2 and 4, the bellows have a raised check valve seat 31 that surrounds an opening in the center of a reinforced bottom wall 32. A check valve member 33 with a cup-shaped upper end is housed within the bellows 18, and a check valve flange 34 rests upon the check valve seat 31. A depending shaft 35 couples the check valve flange 34 to the actuator button 14, through the bottom wall 32 of the bellows 18, so that the actuator button 14 and the shaft 35 move in unison. When the bellows 18 is not collapsing as fast as the actuator button 14 is moving upward, the check valve flange 34 moves apart from the check valve seat 31 against the force of a spring (not shown) in the upper end of the actuator button 14, to allow more air to escape and to allow the bellows 18 to collapse more rapidly.

Still referring to FIGS. 2 and 4, a bellows return spring 36 encircles the check valve member 33, and is captured between the check valve flange 34 at the bottom and an annular seat formed on the bottom of the timer housing 20 around the barrel 21 enclosing the air passageway 23. This bellows return spring 27 provides a downward force upon the check valve flange 34 and the bottom wall 32 of the bellows 18; however, the rate of downward movement of the bellows 18 is limited by the amount of air which can be taken into its interior. By admitting air into the bellows 18 at a controlled rate, downward movement of the actuator button 14 is controlled to provide a time delay.

Figure 3:
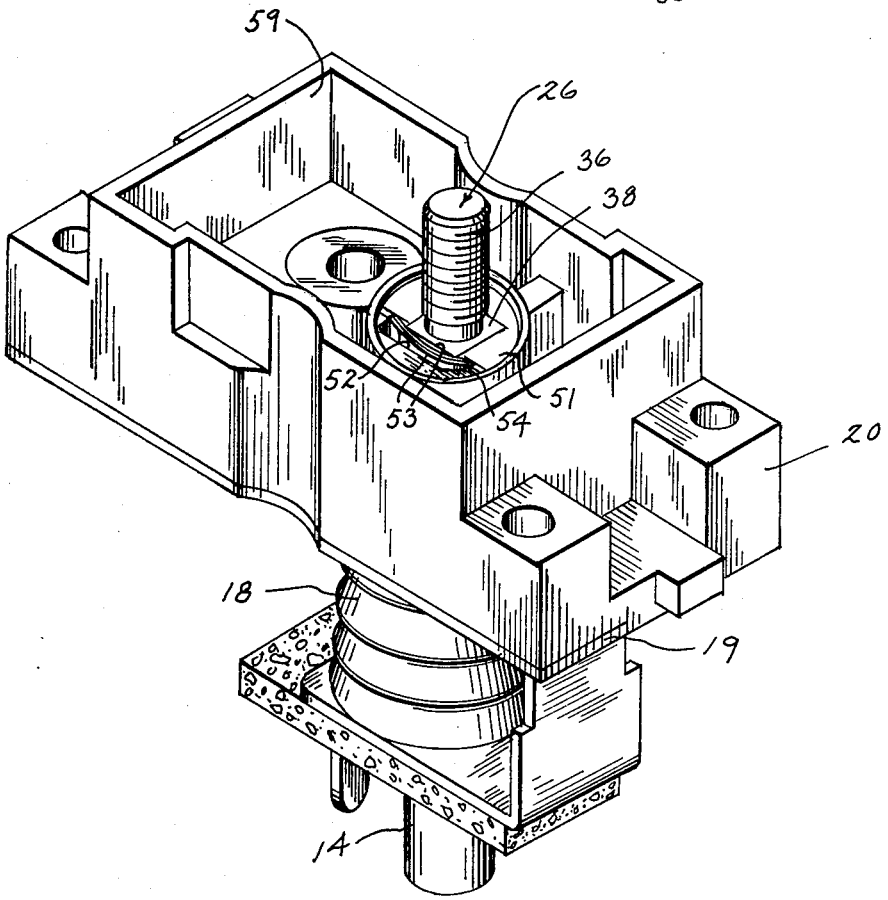
FIG. 3 is a perspective view of the pneumatic timer of FIGS. 1 and 2, with the cover and gear mechanism removed to provide a view into the top of the valve chamber.

The amount of air admitted and released through the air passageway 23 is determined by the vertical movement of the valve needle 26, seen in FIGS. 2 and 4. The valve needle 26 is raised or lowered to insert or withdraw the valve stem 24, and to thereby regulate the size of the bleed area between the valve stem 24 and the valve seat 22. Both the valve stem 24 and the valve seat 22 taper the same amount from wide to narrow as they extend downward. The upper end of the valve needle 26, seen best in FIG. 3, is formed as a threaded shaft 36 for engagement within a central opening of an adjustment knob 37, as seen in FIGS. 1 and 4. The adjustment knob 37 controls the elevation of the valve needle 26 and the position of the valve stem 24 relative to the valve seat 22. The valve needle 26 also has a rectangular flange 38 between its stem 24 and its threaded shaft 36 to prevent the needle from rotating within the valve chamber 25.

Referring again to FIG. 2, a gear mechanism includes a small diameter driving gear 39 that is formed as an integral part of the adjustment knob 37. This gear 39 meshes with a relatively larger intermediate gear 40 that is formed together with a pinion gear 41 to provide an idler gear member 42. The idler gear member 42 is mounted by a boss 43 that fits in a bearing seat 44 in the body 20. The pinion gear 41 engages a large output gear 45 that encircles the adjustment knob 37 and rotates independently of the adjustment knob 37. As explained in the copending application, Ser. No. 895,728, cited above, these gears are selected to provide a gear reduction between the movement of the adjustment knob 37 and the movement of a reference marker 46 seen in FIG. 1. The reference marker 46 is formed on a raised annular portion 47 of the output gear 45, seen best in FIG. 2. A transparent collar 48 fits around the adjustment knob 37 and allows the reference marker 46 to be observed as seen in FIG. 1. The transparent collar 48 is serrated around its periphery to be more easily grasped and turned to adjust the elevation of the valve needle 26. As seen in FIG. 2, the gear mechanism just described is enclosed within a body cavity 59, by a top cover plate 49 on which a scale 50 is provided as seen in FIG. 1.

In practice, the scale 50 on the top cover plate 49 provides an approximate setting for the time delay operation of the timer 11. To set the timer 11, the reference marker 46 is aligned with a mark on the scale 50 that represents the desired time delay. The actual timing operation is then observed and the actual result compared with the scale mark. The adjustment knob 37 can then be further rotated in either direction by grasping the transparent collar 48 and rotating it to obtain a more exact setting.

A characteristic of mechanically adjustable devices, such as the timer 11, is "backlash." Backlash is measured by adjusting a device to a first setting to obtain a given output, such as the advance of the actuator button 14 over a time delay period. The adjustment knob 37 is first rotated several turns in one direction and then rotated back to a second setting, which provides the same output as the first setting. Due to backlash these two settings do not coincide as measured by the scale 50 on the cover plate 49.

As seen best in FIG. 4, a rotational movement of the adjustment knob 37 is translated into an axial movement of the valve needle 26, to cause an advance into, or a withdrawal from, the threaded opening in the adjustment knob 37. The needle flange 38 cannot completely eliminate rotation because its manufacturing tolerance is such that a small gap exists between its edges and the inside walls of the valve chamber 25. Therefore, absent the invention, the valve needle 26 would be allowed to rotate a short distance before being restricted by the interior walls of the valve chamber 25. During this rotation, the valve needle 26 does not move axially, but the reference marker 46 is driven through the gear mechanism. This play between the valve needle 26 and the reference marker 46 provides some amount of mechanical backlash or hysteresis.

In most instances, nonaxial movement of the valve needle 26, including rotation, shifting or tilting, affects the shape of the bleed area between the valve needle stem 24 and the valve seat 22. The crescent-shaped bleed area provided by the present invention is shown in FIGS. 7 and 10. In the prior art it was the practice to dispose the valve stem 24 concentrically in the air passageway 23 so that the longitudinal axes of the valve needle 26 and the air passageway 23 coincided. A truly concentric relationship is difficult to obtain, however, because the valve stem 24 and the valve seat 22 may not be perfectly circular in cross section, and the longitudinal axis of the valve needle 26 may be shifted or tilted slightly due to the sum effects of tolerance variations in the adjustment mechanism. In the present invention, as seen in FIGS. 7 and 10, the axis of the valve needle 26 is off-center from the axis of the air passageway 23 so that the needle 26 is eccentrically disposed in the air passageway 23. This is accomplished by biasing the needle 26 within the valve chamber 25.

As shown in the preferred embodiment of the invention in FIGS. 3, 4 and 6, the valve chamber 25, which is formed in a hub 51 of the timer body 20, is enlarged on one side to form a spring seat 52. The spring seat 52 and two planar, biasing springs 53 disposed therein, extend the length of the valve chamber 25 as seen in FIG. 4. The spring seat 52 is wider than the valve chamber 25, as seen in FIGS. 3 and 6, and includes two corners 54 formed within the hub 51 to hold opposite edges of the springs 53 slightly inward of two corners of the needle flange 38. The springs 53 are thereby held in concave position against one side of the needle flange 38. A washer 60 slides down over the needle shaft 34 and seals the top of the valve chamber 25 as seen in FIG. 4. The springs 53 exert a lateral force on one side of the needle flange 38 to urge the valve needle 26 in a lateral direction until the tapered stem 24 contacts a portion of the valve set 22 as seen in FIGS. 4 and 7.

The springs 53 have a nominal thickness of 0.004 inches and are of cold rolled, carbon spring steel A1S1 1095, Rockwell Coefficient 48/51, tempered, polished and blued. The springs 53 have a relatively high spring rate of 1,050 pounds/inch, which is lowered slightly from the individual spring rate with the use of two nested springs 53, as seen in FIG. 5, instead of a single spring. A single spring of suitable spring rate can also be used.

In usage, the springs 53 become permanently creased a slight amount so that the corners of the needle flange 38 track in the creases 55 seen in FIG. 5. Thus, the springs 53 take a small amount of set which compensates for tolerance variations to maintain a relatively constant biasing force, even when the timer is subjected to vibrations of the type encountered in an industrial environment. The valve needle 26 is also guided as the corners of the needle flange 38 track along their respective creases 55 in the springs 53.

In a second embodiment illustrated in FIGS. 8–10, a curlicue spring 53*a* with fluted sides is disposed in a rectangular valve chamber 25*a* and bears against two sides of the valve needle flange 38. As seen in FIG. 10, the needle stem 24 is again urged laterally into engagement with the valve seat, however, at a slightly different location than in the previous embodiment. In both embodiments, the valve stem 24 maintains its contact with the valve seat 22 as it is inserted into and retracted from various positions within the air passageway 23. The curlicue spring 53*a* is preferably made of 0.005 inch nominal thickness, spring-tempered stainless steel.

In both of these embodiments backlash and needle rotation are minimized. The size of the bleed area and the volume of the open part of the air passageway 23 changes as the position of the needle is adjusted, however, the shape of the bleed area remains substantially constant.

FIG. 11 is a semilog plot of the timing function curve 56 for a typical pneumatic timer. It shows time delay in seconds, on a logarithmic scale, as a function of turns of an adjustment knob, plotted on a linear scale. Ideally, this graph should approximate a straight line so that an incremental change ($\Delta T_1'$) between, for example, three turns and four turns of the adjustment knob 37, will produce the same ratio ($\Delta t/t$) of change in the time delay operation as an adjustment of the knob 37 from six turns to seven turns ($\Delta T_2'$). For two settings $S_1$ and $S_2$ of the timer in FIG. 11, it can be seen that a decrease in the time delay to points $S_1'$ and $S_2'$, respectively, produces a ratio of change in the time delay of the same order. This is also true for an increase in the time delay achieved by clockwise operation of the adjustment knob 37 to change the setting from points $S_1$ and $S_2$ to points $S_2''$ and $S_2''$, respectively.

The timing curve should ideally be as smooth as possible without alternating peaks and depressions. These peaks and depressions are usually observed when a portion of a timing curve 57 is examined on an enlarged scale as seen in FIG. 12. There the time delay does not decrease at the same rate and, in fact, increases at around three turns. This makes it difficult to obtain a fine setting for the timer, because after the first, coarse setting, a smaller adjustment of the knob may result in a time delay that is farther from the desired value than observed with the first setting. Such a timing curve results from a change of shape of the bleed area caused by tolerance variations in the mechanical parts of the timer.

A timing function curve 58 for a sample of a pneumatic timer that incorporates the present invention is seen in FIG. 13. The curve approximates a straight line in the examined segment, and no peaks or depressions are observed. This means that the pneumatic timer will be more easily and more exactly set for the desired period of time delay operation. It also means that any tolerance variations in the mechanical parts of the timer adjustment have been minimized or compensated for.

Although the needle flange 38 provides a convenient point to apply biasing force, other embodiments of the invention may apply this biasing force to other portions of the valve needle. Therefore, the following claims shall define the scope of the invention.

I claim:

1. In a pneumatic timing device with improved adjustability, the combination comprising:

a bellows;

a body having a valve chamber and having a passageway of substantially circular cross section that extends along a longitudinal axis from the valve chamber into the interior of the bellows, the body forming a valve seat around the passageway;

a valve needle with a longitudinal needle axis, with a shaft disposed for axial movement in the valve chamber and with a non-circular cross section portion formed around its shaft, positioned within the valve chamber, and cooperating with a non circular cross section portion of the body to restrict rotation of the needle, the valve needle also forming a valve stem of substantially circular cross section that extends along the needle axis into the passageway;

biasing means, disposed within the valve chamber in relative sliding contact against at least one side of the valve needle portion that restricts rotation and extending the distance traveled by such restricting portion, for urging the valve stem into contact with a portion of the valve seat, and into a position where the needle axis is spaced off-center from the longitudinal axis of the passageway to form a crescent-shaped bleed area; and a rotatable adjustment means mounted on the body and coupled to the valve needle for axial movement of thevalve needle along the biasing means, the portion of the valve needle that restricts its rotation being in sliding contact with the biasing means to further restrict rotation and to limit tilt of the valve needle, thereby maintaining the shape and the orientation of the bleed area.

2. The pneumatic timing device of claim 1, wherein the portion of the valve needle that restricts its rotation includes a rectangular needle flange, and wherein the biasing means includes at least one spring that is substantially planar before being seated in the valve chamber, the spring being held concavely against one side of the flange and being creased by the sliding movement of the flange to become set in its operating position.

3. The combination of claim 1, wherein the portion of the valve needle that restricts its rotation includes a rectangular needle flange, and wherein the biasing means is a curlicue spring that is seated in the valve chamber and urged against at least two sides of the needle flange to securely hold the valve needle in its operating position.

* * * * *